US009038402B2

(12) United States Patent
Sonninen

(10) Patent No.: US 9,038,402 B2
(45) Date of Patent: May 26, 2015

(54) APPARATUS AND METHOD FOR SEPARATING DROPLETS FROM VAPORIZED REFRIGERANT

(75) Inventor: Jyrki Sonninen, Raisio (FI)

(73) Assignee: VAHTERUS OY, Kalanti (FI)

( * ) Notice: Subject to any disclaimer, the term of this patent is extended or adjusted under 35 U.S.C. 154(b) by 1699 days.

(21) Appl. No.: 12/445,641

(22) PCT Filed: Oct. 12, 2007

(86) PCT No.: PCT/FI2007/000243

§ 371 (c)(1),
(2), (4) Date: Oct. 12, 2010

(87) PCT Pub. No.: WO2008/046951

PCT Pub. Date: Apr. 24, 2008

(65) Prior Publication Data

US 2011/0016892 A1 Jan. 27, 2011

(30) Foreign Application Priority Data

Oct. 16, 2006 (FI) ..... 20060915

(51) Int. Cl.
*F25B 47/00* (2006.01)
*F25B 43/00* (2006.01)

(52) U.S. Cl.
CPC ..... *F25B 43/00* (2013.01); *F25B 2400/16* (2013.01); *F25B 2400/23* (2013.01)

(58) Field of Classification Search
CPC ..... F28F 13/14; F25B 47/00; F25B 2400/23; B01D 9/0004; B01D 9/0018
USPC ..... 62/85, 112, 515, 474, 511; 165/132
See application file for complete search history.

(56) References Cited

U.S. PATENT DOCUMENTS

| | | | |
|---|---|---|---|
| 1,715,828 | A | 6/1929 | Gay |
| 1,994,037 | A | 3/1935 | Gay |
| 2,156,426 | A | 5/1939 | Brown et al. |
| 2,277,647 | A | 3/1942 | Jones |
| 2,570,962 | A | 10/1951 | McBroom |
| 2,859,596 | A | 11/1958 | Evans |

(Continued)

FOREIGN PATENT DOCUMENTS

| | | | | |
|---|---|---|---|---|
| DE | 3206967 | A1 * | 9/1983 | ..... F25B 27/00 |
| DE | 32506967 | A1 * | 9/1983 | ..... F25B 27/00 |

(Continued)

OTHER PUBLICATIONS

International Search Report for PCT/FI2007/000243, mailed Apr. 17, 2008.

*Primary Examiner* — Frantz Jules
*Assistant Examiner* — Emmanuel Duke
(74) *Attorney, Agent, or Firm* — Nixon & Vanderhye P.C.

(57) ABSTRACT

The invention relates to an apparatus and a method for separating droplets from vaporized refrigerant. The droplet separator according to the invention has a separation vessel, where the droplets gravitationally separate from the vaporized refrigerant. A partition plate has been arranged in the separation vessel, which partition plate divides the separation space into two separation parts. Thereby the refrigerant is arranged—to pass firstly through the first separation space on the first side of the partition plate, —then to transfer to the second side of the partition plate, i.e. to the second separation space—then to pass through the second separation space on the second side of the partition plate.

13 Claims, 4 Drawing Sheets

(56) References Cited

U.S. PATENT DOCUMENTS

| | | | | | |
|---|---|---|---|---|---|
| 3,483,714 | A | * | 12/1969 | Krause et al. | 62/503 |
| 4,232,533 | A | | 11/1980 | Lundblad | |
| 4,310,338 | A | * | 1/1982 | Schumacher et al. | 62/470 |
| 4,329,854 | A | * | 5/1982 | Schmidt | 62/470 |
| 4,472,949 | A | * | 9/1984 | Fujisawa et al. | 62/473 |
| 4,528,826 | A | * | 7/1985 | Avery, Jr. | 62/503 |
| 4,622,048 | A | * | 11/1986 | Roberts et al. | 96/188 |
| 5,029,448 | A | * | 7/1991 | Carey | 62/84 |
| 5,222,378 | A | * | 6/1993 | Chuan | 62/474 |
| 5,271,245 | A | * | 12/1993 | Westermeyer | 62/470 |
| 5,704,215 | A | * | 1/1998 | Lord et al. | 62/84 |
| 2004/0065110 | A1 | * | 4/2004 | Barratt et al. | 62/471 |
| 2004/0256088 | A1 | * | 12/2004 | Ayub | 165/132 |

FOREIGN PATENT DOCUMENTS

| | | | | | |
|---|---|---|---|---|---|
| DE | 3306232 | A1 | * | 8/1984 | F25B 39/04 |
| EP | 1 363 090 | | | 11/2003 | |
| JP | 62-119375 | | | 5/1987 | |
| JP | 10246538 | | * | 9/1998 | F25B 43/00 |
| JP | 10246539 | | * | 9/1998 | F25B 43/00 |
| JP | 2005-265388 | | | 9/2005 | |

* cited by examiner

APPARATUS AND METHOD FOR SEPARATING DROPLETS FROM VAPORIZED REFRIGERANT

This application is the U.S. national phase of International Application No. PCT/FI2007/000243, filed 12 Oct. 2007, which designated the U.S. and claims priority to Finland Application No. 20060915, filed 16 Oct. 2006, the entire contents of each of which are hereby incorporated by reference.

TECHNICAL FIELD OF THE INVENTION

The object of the invention is an apparatus and a method for separating droplets from vaporized refrigerant according to the preambles of the independent claims presented below. The invention relates especially to a new droplet separator, which ensures that refrigerant droplets are not carried to the compressor, which is used in the refrigerating machinery.

PRIOR ART

One important application of plate heat exchangers is a so-called flooded evaporator, which is used in large refrigerating machineries, and a droplet separator associated therewith. The task of the droplet separator is to ensure that refrigerant droplets are not carried to the compressor of the refrigerating machinery. Droplets are extremely harmful, since they easily cause the compressor to break down. The droplet separator has to be dimensioned large enough and the distance between the suction and outlet opening adequate, so that the droplets have time to fall to the bottom of the separator before the end up in the compressor along with the suction gas. On the other hand the large size of the separator increases the production costs and the mass of the system, and the space it requires is large.

OBJECT AND BRIEF DESCRIPTION OF THE INVENTION

An object of the present invention is to reduce or even to eliminate above-mentioned problems appearing in the prior art.

An object of the present invention is to provide a solution, with which the efficiency of the droplet separator, which is in connection with the flooded evaporator of the refrigerating machinery, is improved.

An object of the present invention is to provide a solution, with which the flooded evaporator and the droplet separator form an entity, which is functionally efficient, economical, small when it comes to size and reliable when it comes to functioning.

An object of the present invention is to provide a new even more efficient manner to separate refrigerant droplets gravitationally.

An object of the present invention is to find such a structure for a gravitational droplet separator, where the droplet separating capacity in relation to the size of the vessel is as advantageous as possible. The object is also for the flow not to generate a large loss of pressure, since this impairs the efficiency of the system.

In order to realize among others the objects mentioned above, the present invention is characterised by what is presented in the characterising parts of the enclosed independent claims.

The embodiment examples and advantages mentioned in this text relate, where applicable, to both the system and the method according to the invention, even if this is not always specifically mentioned.

In this context the refrigerant refers to the circulating medium, i.e. working medium, of vaporization processes used in refrigerating machineries. Such refrigerants are for example ammonia, carbon dioxide and CFC agents.

A typical apparatus according to the invention for separating droplets from vaporized refrigerant comprises a droplet separator, which has a separation vessel, through which the refrigerant is arranged to flow. In the separation vessel the droplets are separated from the vaporized refrigerant gravitationally. The apparatus includes connections for leading the vaporized refrigerant coming from the evaporator to the first end of the separation vessel and connections for leading the vaporized refrigerant out of the droplet separator from the second end of the separation vessel. The apparatus also includes connections for leading the liquid refrigerant from the separation vessel to the evaporator. In a typical apparatus according to the invention a partition plate has been arranged in the separation vessel, which partition plate divides the separation space into two separation parts. The vaporized refrigerant and the droplets to be separated amongst it are arranged to flow first on the first side of the partition plate through the first separation space. Typically at least the largest droplets separate already in the first separation space. Thereafter the vaporized refrigerant and the droplets still amongst it are arranged to transfer to the second side of the partition plate, i.e. to the second separation space. On this second side of the partition plate the refrigerant is then arranged to flow through the second separation space. More droplets separate from the vaporized refrigerant as it flows through the second separation space.

The droplet separator according to the invention can be divided also into more than two separation parts with the aid of one or more partition plates.

It has now thus surprisingly been found that one and the same separation vessel of a gravitational droplet separator can, by means of one or more simple plates, be divided into two or more separation spaces. Thus the vaporized refrigerant flowing in a separation vessel of a certain volume can be made to flow a longer distance and over a longer time. This substantially boosts the droplet separating capacity of the droplet separator.

With the aid of the invention a more effective utilization especially of the flow cross-section of the droplet separator is achieved.

With the aid of the invention the mass of the droplets, which have passed through the droplet separator, can be made to be a fraction in comparison to prior art solutions, when the size of the vessel and the circumstances are the same. At the same time it is also possible to reduce the loss of pressure in the droplet separator.

It is possible to functionally link the droplet separator according to the invention to an evaporator, i.e. a heat exchanger, where refrigerant is vaporized. It is possible for the apparatus according to the invention to also comprise a refrigerating machinery and necessary connections for leading the vaporized refrigerant from the droplet separator to the compressor of the refrigerating machinery and for leading the at least partly liquid refrigerant from the high-pressure part of the refrigerating machinery to the droplet separator.

The main parts of a typical refrigerating machinery, in which an apparatus according to the invention can be used, are in addition to the evaporator and the droplet separator a compressor, a condenser, an expansion or float valve and a pipe system, which connects the parts. The evaporation process is divided into a low-pressure and a high-pressure part. The low-pressure part includes an evaporator and droplet separator with pipe systems, the high-pressure part includes a condenser and an expansion or float valve with pipe systems. Refrigerating machineries are known as such, and they will not be discussed here in further detail.

In an embodiment of the invention the apparatus comprises connections for leading at least partly liquid refrigerant from the refrigerating machinery to the first end of the separation vessel of the droplet separator.

In an embodiment of the invention the partition plate is arranged mainly horizontal. The partition plate can also be arranged somewhat inclined, for example 1-10% in relation to the horizontal plane, whereby liquid, which has separated onto it, automatically flows away. Openings can be arranged into the partition plate or between the partition plate and the inner walls of the collection vessel for leading liquid to the bottom of the collection vessel.

In an embodiment of the invention the separation vessel has an elongated shape and the partition plate is arranged parallel with the separation vessel. Thereby the connections in the first and second end of the separation vessel are placed in the same end of the separation vessel, but on different sides of the partition plate. In other words, thereby the first end of the first separation space and the second end of the second separation space are in the same end of the separation vessel of the droplet separator. The fact that the necessary connections are in the same end of the droplet separator often facilitates the installation of the device.

In an embodiment of the invention the elongated separation vessel is installed mainly in a horizontal position. Thereby, if the partition plate is mainly horizontal, it divides the separation vessel into two mainly horizontal separation parts. The elongated separation vessel can also be placed in a vertical or inclined position.

In an embodiment of the invention the first and second separation space are approximately equally large when it comes to volume. In other words the partition plate is placed approximately in the middle of the separation space. The volume of the first and the second separation space may differ by for example less than 10% or less than 20%. In an embodiment of the invention refrigerant is led approximately the same distance in the first and the second separation space.

In an embodiment of the invention the partition plate is in its one end closed and in its other end perforated. Through the openings the vaporized refrigerant is led from one side of the partition plate to the other, i.e. from the first separation space to the second separation space. Typically the partition plate is closed in that end, where the inlet connections for the vaporized refrigerant open in the first separation space, i.e. in the first end of the separation vessel. Typically, on the second side of the partition plate, in the second separation space, this same closed end of the partition plate delimits the second end of the separation vessel, i.e. the end from where the connections for leading refrigerant to the refrigerating machinery start.

In an embodiment of the invention a baffle plate is attached on top of the perforated part of the partition plate in the second separation space, which baffle plate is directed first perpendicularly against the direction of the perforated part and then bent towards the second end of the separation vessel. The baffle plate divides the second separation space into two smaller parts. The object of the baffle plate is to turn the flow of refrigerant, which has flowed into the second separation space, in a controlled manner toward the second end of the separation vessel. In an embodiment the baffle plate is in the middle of the perforated part of the partition plate, in such a manner that at least 30% of the perforation remains on each side of the baffle plate.

The solution according to the invention can be carried out with various heat exchangers, such as with plate heat exchangers or pipe heat exchangers. In an embodiment a heat exchanger refers to a plate heat exchanger according to the so-called Plate & Shell™ technology developed by the applicant, which plate heat exchanger comprises a stack of plates formed by heat exchanger plates and a shell surrounding it. The stack of plates is formed of several plate pairs. Each plate pair is formed of two heat exchanger plates, which are welded together at least at their outer periphery. Each heat exchanger plate has at least two first openings for the flow of the first heat exchange medium. Adjacent plate pairs are fastened together by welding or by otherwise combining the first openings of two adjacent plate pairs to each other. Thus, the first heat exchange medium can flow from a plate pair to another via the first openings. The second heat exchange medium is arranged to flow inside the shell in the spaces between the plate pairs.

Inlet and outlet connections for the first as well as for the second heat exchange medium have been arranged through the shell of the Plate & Shell™ plate heat exchanger. The inlet and outlet connection of the first heat exchange medium has been arranged in connection with the inner parts of the stack of plates, i.e. with the inner parts of the plate pairs. The primary circuit of the plate heat exchanger is thus formed between the inlet and outlet connection of the first heat exchange medium, inside the plate pairs. The inlet and outlet connection of the second heat exchange medium has been arranged in connection with the inside of the shell, i.e. with the outside of the stack of plates, i.e. with the outer sides of the plate pairs. In other words, the secondary circuit of the plate heat exchanger is formed between the inlet and outlet connection of the second heat exchange medium, inside the shell, in the spaces between the plate pairs. Typically, the primary and secondary circuits are separate from each other, i.e. the first heat exchange medium flowing in the inner part of the stack of plates cannot get mixed with the second heat exchange medium flowing in the shell, i.e. outside the stack of plates. Thus, the first primary heat exchange medium flows in every other space between two plates and the second secondary heat exchange medium flows in every other space between two plates of a plate heat exchanger according to the invention.

BRIEF DESCRIPTION OF THE FIGURES

The invention is described in more detail below with reference to the enclosed schematic drawing, in which.

DETAILED DESCRIPTION OF THE EXAMPLES OF THE FIGURES

For the sake of clarity, the same reference numbers have been used for parts corresponding to each other in different examples.

Figure 1:
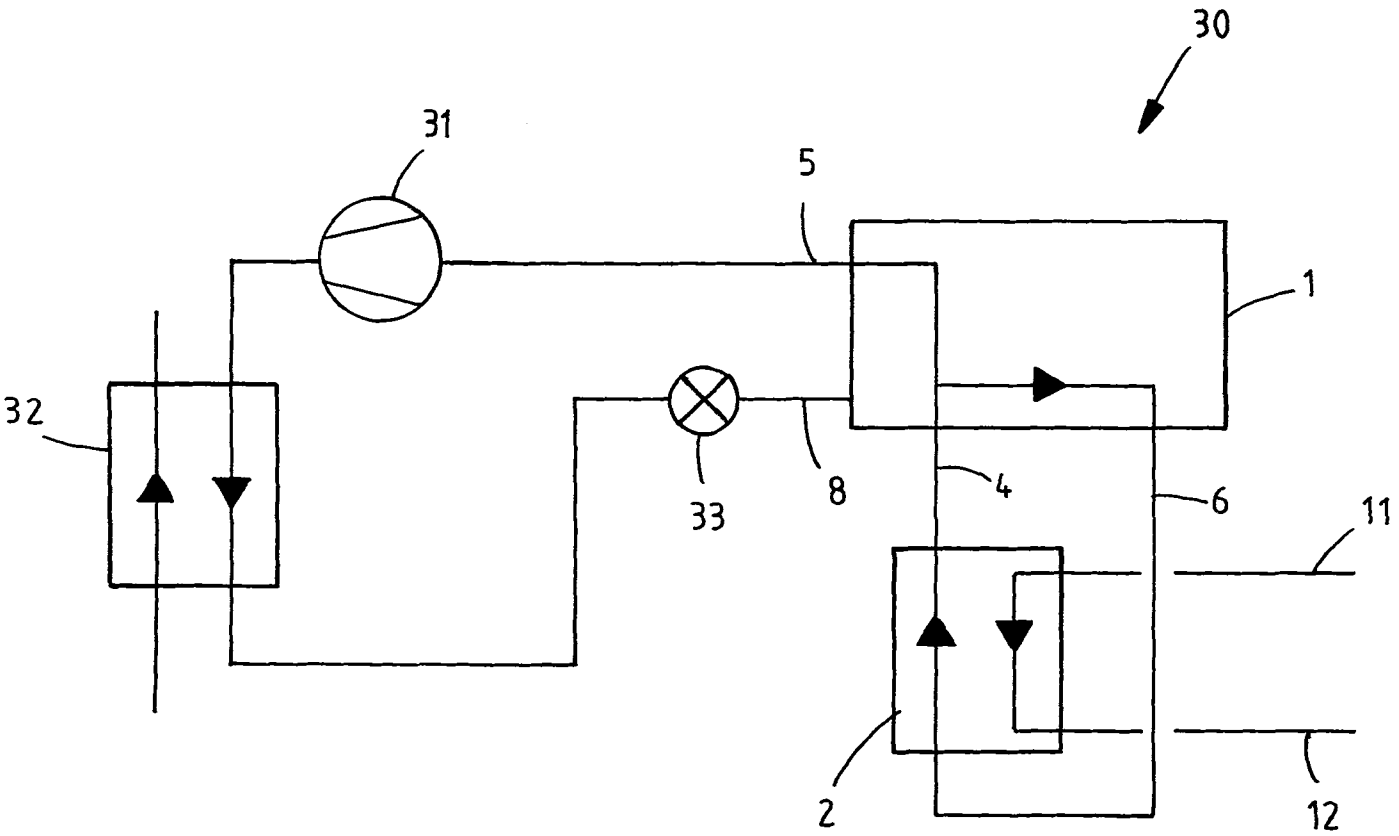
FIG. 1 shows a principle chart of a refrigerating machinery of the type in question.

FIG. 1 shows an example of a principle chart of a refrigerating machinery 30 according to the invention. The main parts of the refrigerating machinery 30 are an evaporator 2 and a droplet separator 1 in connection with it, a compressor 31, a condenser 32, an expansion or float valve 33 and a pipe system, which connects the parts. The evaporation process is divided into a low-pressure and a high-pressure part. The low-pressure part includes an evaporator 2 and droplet separator 1 with pipe systems, the high-pressure part includes a condenser 32 and an expansion or float valve 33 with pipe systems.

Figure 3:
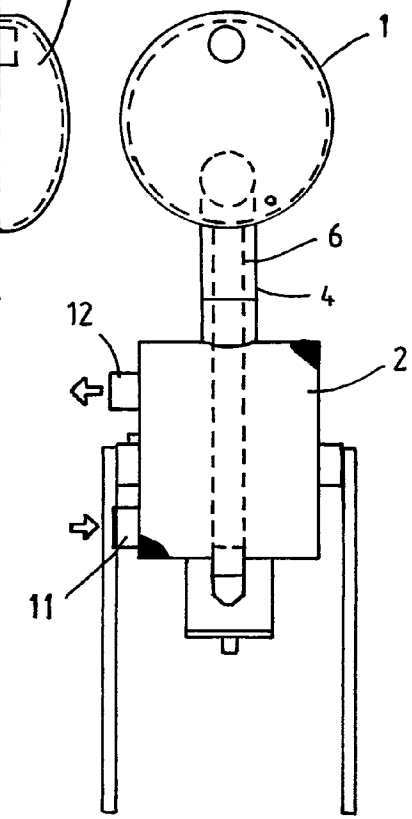
FIG. 3 shows the solution of FIG. 2 in an end view.
Figure 2:
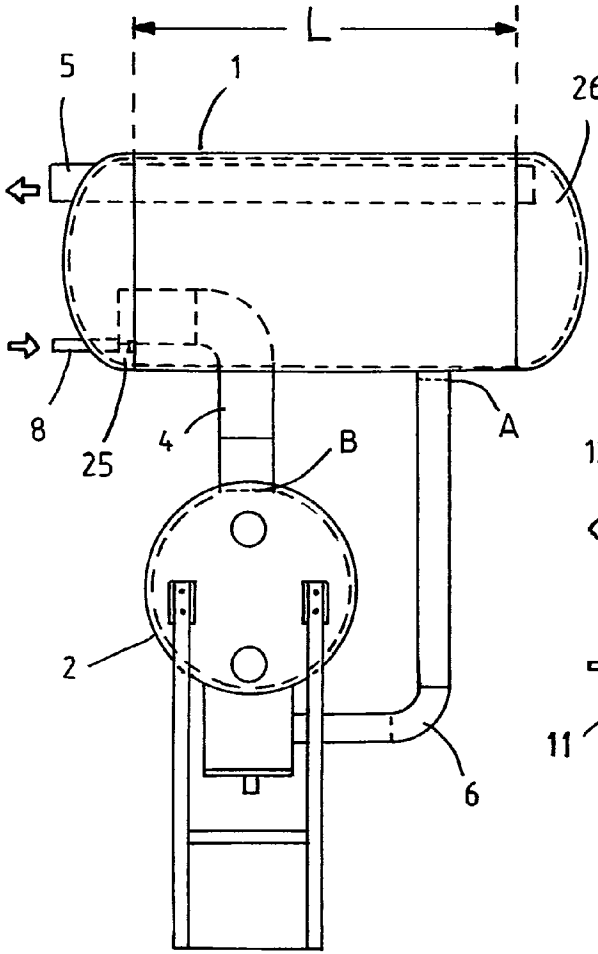
FIG. 2 shows a flooded evaporator and a droplet separator as seen from the side and partly in a cut view.

FIGS. 2 and 3 show a typical technical solution, which is presently in use, where a flooded evaporator 2, i.e. a plate heat exchanger, and a droplet separator 1 together form a functional entity. The refrigerant, typically ammonia, which comes from the high-pressure part of the refrigerating machinery 30, is fed from the expansion valve or float valve 33 through a pipe 8 into the droplet separator 1 as a mixture of liquid and vapour. The refrigerant which is in the liquid phase circulates through the circulating pipe 6 to the flooded evaporator. The flow medium which flows on the second side of the heat exchanger 2, and which has a higher temperature, cools down and the refrigerant is partly evaporated. The warm flow medium is fed to the heat exchanger 2 from the inlet connection 11 and it exits through the outlet connection 12. The vaporized refrigerant rises through the pipe 4 to the first end 25 of the droplet separator. The saturated vapour is suctioned to the compressor through the pipe 5 from the second end 26 of the droplet separator. Altogether the length of the journey the vaporized refrigerant has to travel in the droplet separator 1 is equal to the largest separation length L. The quantity of the refrigerant is usually adjusted so that it is in the circulation pipe 6 at the level A of the lower edge of the droplet separator, and on the side of the heat exchanger as much lower as the loss of pressure caused by the flow makes it, typically at the level B of the higher edge of the exchanger.

Figure 5:
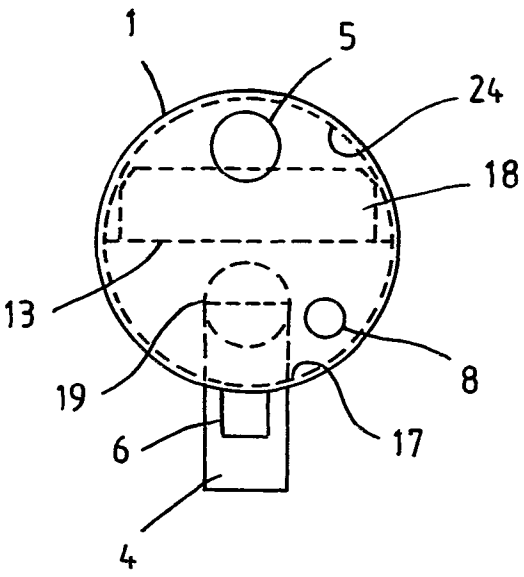
FIG. 5 shows a cross-section of the solution of FIG. 4 in an end view.
Figure 4:
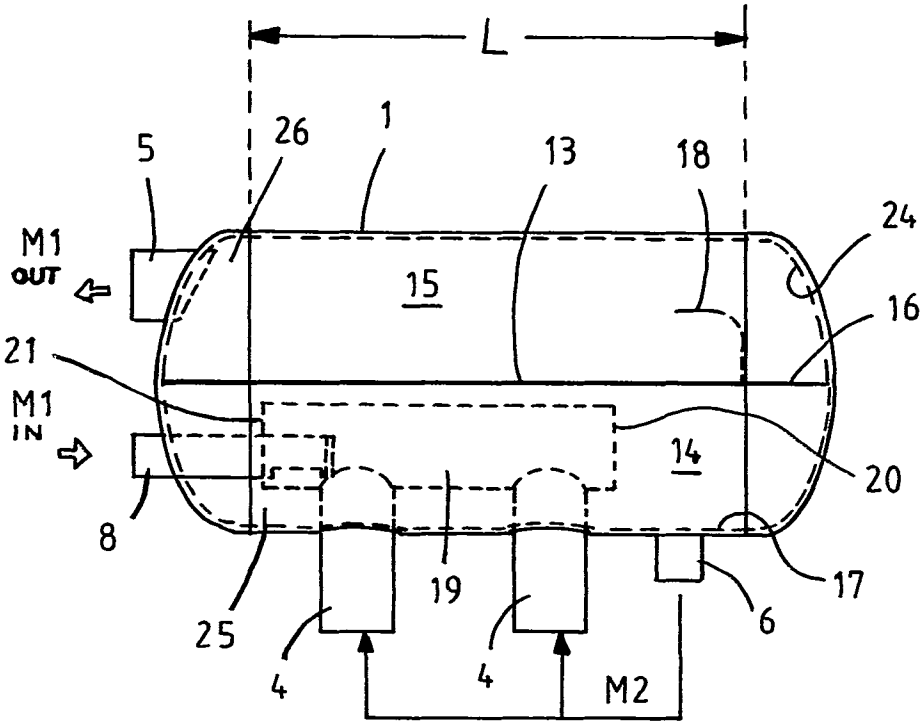
FIG. 4 shows a cross-section of a droplet separator according to the invention as seen from the side.
Figure 6:
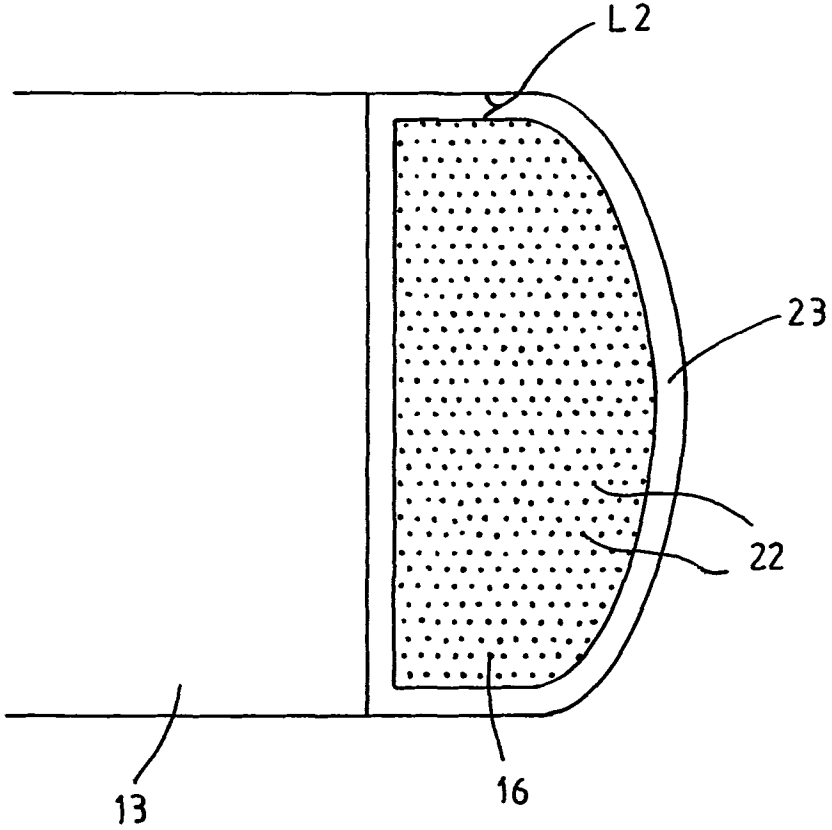
FIG. 6 shows a magnified view of a detail of the droplet separator of FIG. 4.

FIGS. 4-6 show only a droplet separator 1 according to the invention. The heat exchanger, which is connected to the droplet separator, can be exactly like the flooded evaporator 2 shown in FIGS. 2-4. Even several, for example 2-5, separate heat exchangers 2 can be connected to the droplet separator 1 in order to improve the vaporizing capacity.

In the structures according to the invention in FIGS. 4-6 the vessel 1 of the droplet separator is divided with a mainly horizontal partition plate 13 into a first separation space 14 and a second separation space 15. The first separation space 14 is in the bottom part of the vessel 1 and the second separation space 15 in the top part of the vessel 1. The separation spaces 14 and 15 are approximately equally large when it comes to volume. The left part of the partition plate 13 is closed. In the right end of the partition plate 13 a part of it is made of perforated plate 16. In the example of the Figure the length of the part made of perforated plate 16 is about 20% of the length of the entire partition plate 13. In the perforated part of the partition plate 16 there can be openings on for example 10-40% of its surface area. The refrigerant (M1in) coming from the high-pressure part of the refrigerating machinery is fed to the left edge 25 of the first separation space 14 of the droplet separator from the inlet connection 8. The mixture of vapour and liquid droplets developed at the evaporator 2 is fed from two pipes 4 to a collector pipe 19, which at its right end 20 is closed and at its left end open. Two pipes 4 can be seen in FIG. 3, to both of which can be attached their own evaporator 2. From the left end 21 of the collector pipe the mixture of vapour and liquid droplets is carried to the left edge 25 of the first separation space 14. From the left edge 25 of the first separation space 14 the mixture of vapour and liquid droplets of refrigerant flows to the entire separation space 14 of the vessel. The droplets have approximately the entire separation length L to fall to the bottom 17 of the vessel. The largest droplets immediately fall to the bottom 17 of the vessel. Through the pipe 6 refrigerant is led from the bottom 17 to one or more evaporators 2 (See FIG. 2). Only a small part of the droplets transfer with the suction gas through the perforated plate 16 to the top of the vessel, i.e. to the second separation space 15. In the second separation space 15 also the rest of the droplets have approximately the entire separation length L to fall to the partition plate 13 and onwards back into the first separation space 14. Altogether the journey the vaporized refrigerant has to travel in the droplet separator 1 is approximately twice the length of L. Only very small droplets are carried to the suction opening 5 (M1out) in the left end 26 of the second separation space. A baffle plate 18 is placed on top of the perforated part 16 of the partition plate, which baffle plate is directed first perpendicularly upwards and then bent towards the suction opening 5. The object of the baffle plate 18 is to stop the flow from necking to the top part of the vessel and thus ensure the even division of the flow in the second separation space 15.

FIG. 6 shows a magnified view of the right end of the partition plate 13 as seen from above. The left end of the plate 13 is closed plate. The right end of the plate 13 is formed to be perforated plate 16. In the perforated plate 16, the diameter of the holes 22 is e.g. 3-5 mm. Around the perforated part 16 of the plate there is however a closed edge 23, meant to be against the inner wall 24 of the vessel 1. The object of the edge 23 is to cut off the tendency of the flow to follow the inner wall 24 of the vessel. The width L2 of the edge can be for example 25-60 mm.

The partition plate 13 can be inclined in relation to the horizontal plane by for example 1-10%. Thus the droplets, which have fallen onto it, flow away. A suitably sized gap can be arranged between the partition plate 13 and the inner wall 24 of the vessel 1, from which gap the droplets can flow to below the plate.

Only one advantageous embodiment of the invention is shown in the Figures. The Figures do not separately show matters that are irrelevant in view of the main idea of the invention, known as such or obvious as such for a person skilled in the art. It is apparent to a person skilled in the art that the invention is not limited exclusively to the examples described above, but that the invention can vary within the scope of the claims presented below. The dependent claims present some possible embodiments of the invention, and they are not to be considered to restrict the scope of protection of the invention as such.

The invention claimed is:

1. A droplet separator for separating droplets from vaporized refrigerant, comprising;

a substantially horizontal droplet separation vessel, having opposed ends and an elongated shape defining a separation space therebetween, wherein the vaporized refrigerant is arranged to flow through the separation vessel to allow, droplets to separate from the vaporized refrigerant gravitationally, within the separation vessel, wherein one end of the separation vessel includes first and second end portions, a first inlet connection for introducing a flow of droplet-containing vaporized refrigerant into the first end portion of the separation vessel, at least one second inlet connection for leading the vaporized refrigerant to the first end portion of the separation vessel, a first outlet connection for leading substantially droplet-free vaporized refrigerant out of the droplet separator from the second end portion of the separation vessel, a second outlet connection for leading liquid refrigerant from the separation vessel, and a partition plate having a first side arranged in the separation vessel to divide the separation space into first and second separation subspaces that allow the vaporized refrigerant to pass sequentially through the first separation subspace on the first side of the partition plate, then to transfer the vaporized refrigerant to the second separation subspace at a second side of the partition plate opposite to the first side thereof, the vaporized refrigerant thereafter passing through the second separation subspace on the second side of the partition plate, wherein the partition plate is arranged parallel and substantially horizontal relative to the separation vessel such that the first inlet and outlet connections of the first and second end portions of the separation vessel are each situated at the one end of the separation vessel on the first and second opposite sides of the partition plate, respectively.

2. The droplet separator according to claim 1, wherein the first and second separation subspaces have an approximately equally large volume.

3. The droplet separator according to claim 1, wherein the partition plate includes a closed end part and perforated end part opposite to the closed end part to allow the vaporized refrigerant to flow from the first side of the partition plate to the opposite second side thereof.

4. The droplet separator according to claim 3, further comprising a baffle plate positioned in the second separation subspace on top of the perforated end part of the partition plate, wherein the baffle plate extends perpendicularly relative to the perforated end part and has a terminal end that is bent towards the second end portion of the separation vessel.

5. The droplet separator according to claim 3, wherein the closed end part of the partition plate is positioned adjacent to the first inlet connection in the first separation subspace at the first end part of the separation vessel.

6. The droplet separator according to claim 1, wherein the first inlet connection leads droplet-containing refrigerant to the first end part of the droplet separation vessel.

7. Refrigerating machinery comprising: the droplet separator according to claim 1, a compressor, an evaporator, a condenser, and an expansion valve, wherein the first outlet connection of the droplet separator leads the vaporized substantially droplet-free refrigerant from the droplet separation vessel to a low pressure part of the compressor, and wherein the first inlet connection of the droplet separator leads droplet-containing refrigerant from a high pressure part of the compressor to the droplet separation vessel, and wherein the expansion valve is positioned between the condenser and the droplet separator and provides a flow of droplet-containing vaporized refrigerant to the first inlet connection of the droplet separator, and wherein the at least one second inlet connection of the droplet separator receives the vaporized refrigerant from the evaporator, and wherein the first outlet connection of the droplet separator leads the substantially droplet-free vaporized refrigerant out of the droplet separator from the second end portion of the separation vessel to the compressor, and wherein the second outlet connection of the droplet separator leads liquid refrigerant from the separation vessel to the evaporator.

8. A method for separating droplets from vaporized refrigerant, the method comprising;

(a) providing a substantially horizontal elongated droplet separation vessel having opposed ends and an elongated shape defining a separation space therebetween, wherein the vaporized refrigerant is arranged to flow through the separation vessel to allow droplets to separate from the vaporized refrigerant gravitationally within the separation vessel, wherein one end of the separation vessel includes first and second end portions, (b) leading the vaporized refrigerant from an evaporator to the first end portion of the separation vessel, (c) leading droplet-containing vaporized refrigerant through the separation vessel and simultaneously separating droplets gravitationally in the separation vessel from the vaporized refrigerant, (d) leading substantially droplet-free vaporized refrigerant out of the separation vessel from the second end portion thereof, (e) leading liquid refrigerant from the separation vessel to the evaporator, and (f) sequentially leading the liquid refrigerant through, a first separation subspace on a first side of a partition plate positioned in the separation vessel, then leading the liquid refrigerant to a second separation subspace at a second side of the partition plate opposite to the first side thereof, and then leading the liquid refrigerant through the second separation subspace on the second side of the partition plate, wherein Steps (c) and (d) are practiced such that each of the droplet-containing vaporized refrigerant and the substantially droplet-free vaporized refrigerant is led into and out of the one end of the separation vessel on the first and second sides of the partition plate, respectively.

9. The method according to claim 8, further comprising vaporizing the refrigerant in the evaporator.

10. The method according to claim 8, further comprising leading the substantially droplet-free vaporized refrigerant from the droplet separation vessel to a low pressure part of a compressor of, and, leading the droplet containing vaporized refrigerant from a high-pressure part of the compressor to the droplet separation vessel.

11. The method according to claim 10, wherein the droplet-containing vaporized refrigerant is led from the high pressure part of the to the first end portion of the droplet separation vessel.

12. The method according to claim 8, wherein the refrigerant flows approximately the same distance in the first and the second separation subspaces.

13. The method according to claim 8, wherein step (f) includes leading the refrigerant from the first side of the partition plate to the second side thereof through openings in a perforated end part of the partition plate.

* * * * *